US006294862B1

(12) United States Patent
Brailove et al.

(10) Patent No.: US 6,294,862 B1
(45) **Date of Patent: *Sep. 25, 2001**

(54) MULTI-CUSP ION SOURCE

(75) Inventors: Adam A. Brailove, Gloucester; Matthew Charles Gwinn, Salem, both of MA (US)

(73) Assignee: Eaton Corporation, Beverly, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,545

(22) Filed: May 19, 1998

(51) Int. Cl.[7] ..... H01J 27/02; H01J 27/08

(52) U.S. Cl. ..... 313/363.1; 313/231.31; 313/231.41

(58) Field of Search ..... 313/359.1, 231.31, 313/231.41, 363.1; 315/111.41; 250/432 R

(56) References Cited

U.S. PATENT DOCUMENTS

| | | | | |
|---|---|---|---|---|
| 4,447,732 | | 5/1984 | Leung et al. | 250/427 |
| 4,486,665 | | 12/1984 | Leung et al. | 250/427 |
| 4,559,477 | | 12/1985 | Leung et al. | 315/111.81 |
| 5,136,171 | | 8/1992 | Leung et al. | 250/492.2 |
| 5,198,677 | * | 3/1993 | Leung et al. | 250/423 R |
| 5,517,084 | | 5/1996 | Leung | 315/111.71 |
| 5,558,718 | | 9/1996 | Leung | 118/723 E |
| 5,563,418 | | 10/1996 | Leung | 250/492.21 |
| 5,760,405 | * | 6/1998 | King et al. | 250/423 R |

FOREIGN PATENT DOCUMENTS

| | | | |
|---|---|---|---|
| 0 054 621 | 6/1982 | (EP) | H01J/27/14 |

OTHER PUBLICATIONS

Forrester, A. Theodore, *Large Ion Beams, Fundamentals of Generation and Propagation*, (A Wiley–Interscience publication, 1988) pp. 204–227. (No month).

Takagi, K., et al., "A High Current Sheet Plasma Ion Source", *Nuclear Instruments and Methods in Physics Research* B37/38 (1989) pp. 169–172 (North–Holland, Amsterdam) (No month).

* cited by examiner

*Primary Examiner*—Michael H. Day
(74) *Attorney, Agent, or Firm*—Lahive & Cockfield, LLP

(57) ABSTRACT

An ion source (26) includes a plasma confinement chamber and a plasma electrode (70) forming a generally planar wall section of the plasma confinement chamber. The plasma electrode (70) has at least one opening (84, 86) for allowing an ion beam (88) to exit the confinement chamber and has a set of magnets (78, 80, 82) that generate a magnetic field extending across the openings (84, 86) in the plasma electrode (70). The openings (84, 86) in the plasma electrode (70) can be fashioned as elongated slots or circular openings aligned along the axis. The ion source (26) can further include a power supply (72) for negatively biasing the plasma electrode relative to the plasma confinement chamber and an insulator (74) for electrically insulating the plasma electrode (70). Cooling tubes can also be provided to transfer heat away from the magnets in the plasma electrode (70).

22 Claims, 6 Drawing Sheets

MULTI-CUSP ION SOURCE

FIELD OF THE INVENTION

The present invention relates generally to an ion source for ion implantation equipment and more specifically to an ion source having a magnetic field that enhances performance of the ion source.

BACKGROUND OF THE INVENTION

Ion implantation has become a standard accepted technology used in doping workpieces such as silicon wafers or glass substrates with impurities in the large scale manufacture of items such as integrated circuits and flat panel displays. Conventional ion implantation systems include an ion source that ionizes a desired dopant element which is then accelerated to form an ion beam of prescribed energy. The ion beam is directed at the surface of the workpiece to implant the workpiece with the dopant element. The energetic ions of the ion beam penetrate the surface of the workpiece to form a region of desired conductivity. The implantation process is typically performed in a high vacuum process chamber which prevents dispersion of the ion beam by collisions with residual gas molecules and which minimizes the risk of the contamination of the workpiece by airborne particulates.

Conventional ion sources consist of a plasma confinement chamber, which may be formed from graphite, having an inlet aperture for introducing a gas to be ionized into a plasma and an exit aperture through which the plasma is extracted to form the ion beam. The plasma comprises ions desirable for implantation into a workpiece, as well as ions which are not desirable for implantation and which are a by-product of the ionization process. The plasma also includes electrons of varying energies.

One example of an ionizing gas is phosphine ($PH_3$). When phosphine is exposed to a high energy source, such as high energy electrons or radio frequency (RF) energy, the phosphine can disassociate to form positively charged phosphorous ($P^+$) ions for doping the workpiece and hydrogen ions. Typically, phosphine is introduced into the plasma confinement chamber and then exposed to the high energy source to produce both phosphorous ions and hydrogen ions. The phosphorous ions and the hydrogen ions are then extracted through the exit aperture into the ion beam. If hydrogen ions in the beam or high energy electrons find their way to the surface of the workpiece, they may be implanted along with the desired ions. If sufficient current densities of hydrogen ions or high energy electrons are present, these ions and electrons may cause an unwanted increase in the temperature of the workpiece that may damage structures such as resists on the surface of the substrate, which are employed to mask regions of the workpiece.

In order to reduce the number of unwanted ions and high energy electrons contained within the ion beam, it is known to provide magnets within the source chamber to separate the ionized plasma The magnets confine undesirable ions and high energy electrons to a region of the source chamber away from the exit aperture and confines the desirable ions and low energy electrons to a region of the source chamber near the exit aperture. Such a magnet arrangement is shown in the applicant's commonly-owned, co-pending U.S. patent application Ser. No. 09/014,472, filed Jan. 28, 1998, entitled Magnetic Filter For Ion Source, now U.S. Pat. No. 6,016,036, issued Jan. 18, 2000, which is incorporated by reference herein as if fully set forth. Other related examples of magnet configurations within an ion source chamber are shown in U.S. Pat. Nos. 4,447,732 and 4,486,665 to Leung et al. The Leung references show a magnetic filter comprised of a plurality of longitudinally extending magnets oriented parallel to each other. The Leung '665 patent also shows a negative ion source having a plasma grid assembly. The plasma grid assembly has a plurality of spaced-apart conductive grid members positioned adjacent the ion extraction zone.

An object of the present invention is to improve upon known ion sources having magnetic filters by forming an ion source having an enhanced magnetic field.

SUMMARY OF THE INVENTION

The ion source of the present invention achieves the objects of the invention by providing a plasma electrode which can form a generally planar wall section of an ion source confinement chamber and having at least one primary magnet and an opposing magnet oriented relative to an opening in the plasma electrode, such that the magnets form a magnetic field extending across the opening. This magnetic field improves the confinement of the plasma within the confinement chamber and filters high energy electrons from the ion beam.

One aspect of the invention provides for an ion source having a plasma electrode with at least one opening for allowing an ion beam to exit the confinement chamber and having at least one primary magnet and an opposing magnet. The primary magnet is coupled to the plasma electrode and is oriented to present one pole along an edge of the opening in the plasma electrode. The opposing magnet is coupled to the plasma electrode and is oriented to present an opposite pole along an opposing edge of the opening in the plasma electrode. The primary magnet and the opposing magnet generate a magnetic field that extends across the opening in the plasma electrode through which the ion beam passes.

According to another aspect of the invention, improved ion beam performance is achieved through a removable and replaceable plasma electrode. The plasma electrode includes at least one opening for allowing an ion beam to exit the confinement chamber and includes at least one primary magnet and an opposing magnet. The primary magnet and the opposing magnet are oriented relative to edges of the opening in the plasma electrode such that they generate a magnetic field that extends across the opening.

Other features of the invention include a power supply for negatively biasing the plasma electrode relative to the plasma confinement chamber and an insulator for electrically insulating the plasma electrode. The openings in the plasma electrode can be fashioned as elongated slots or circular opening aligned along an axis. In the case of an array of circular openings, the primary magnet and the opposing magnet are positioned relative to the openings such that the magnetic field is generally oriented at an angle $\Theta$ relative to the axis, where the angle $\Theta$ is greater than 0 degrees and less than 90 degrees. The invention can further include cooling tubes for transferring heat away from the magnets coupled with the plasma electrode. The cooling tubes can be mounted adjacent to the magnets or the tubes can enclose the magnets.

BRIEF DESCRIPTION OF THE DRAWINGS

The foregoing and other objects, features and advantages of the invention will be apparent from the following description and apparent from the accompanying drawings, in which like reference characters refer to the same parts throughout the different views.

DETAILED DESCRIPTION OF ILLUSTRATED EMBODIMENTS

Figure 1:
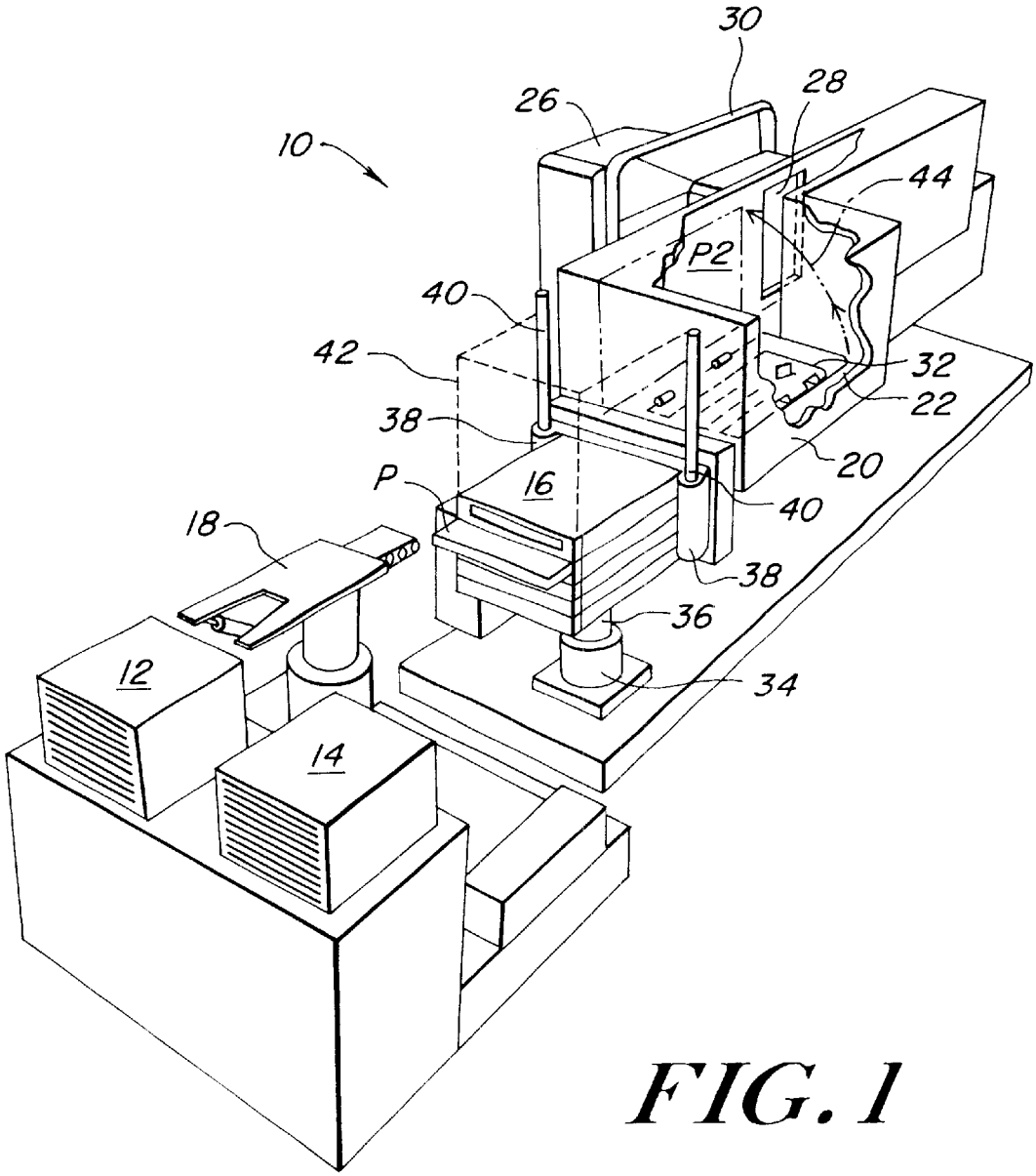
FIG. 1 is a perspective view of an ion implantation system into which an ion source constructed according to the invention is incorporated.

FIG. 1 shows an ion implantation system 10 for implanting large area substrates such as flat panels P. The system 10 comprises a pair of panel cassettes 12 and 14, a loadlock assembly 16, a robot or end effector 18 for transferring panels between the loadlock assembly and the panel cassettes, a process chamber housing 20 providing a process chamber 22, and an ion source 26. Panels P are serially processed in the process chamber 22 by an ion beam emanating from the ion source which passes through an opening 28 in the process chamber housing 20. Insulative bushing 30 electrically insulates the process chamber housing 20 and the ion source housing 26 from each other.

Panel P is processed by the system 10 as follows. The end effector 18 removes a panel to be processed from cassette 12, rotates is 180°, and installs the removed panel into a selected location in the loadlock assembly 16. The loadlock assembly 16 provides a plurality of locations into which panels may be installed. The process chamber 22 is provided with a translation assembly that includes a pickup arm 32 which is similar in design to the end effector 18.

Figure 4:
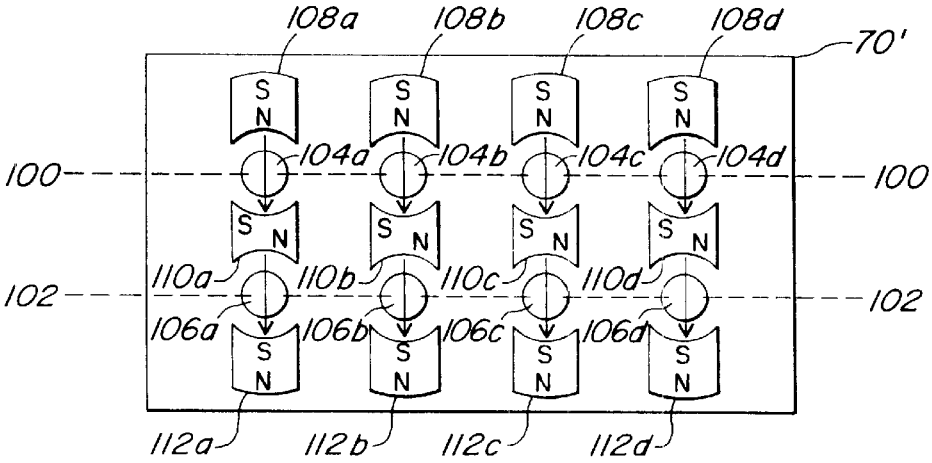
FIG. 4 is a cross-sectional view of an alternative plasma electrode configuration.
Figure 5:
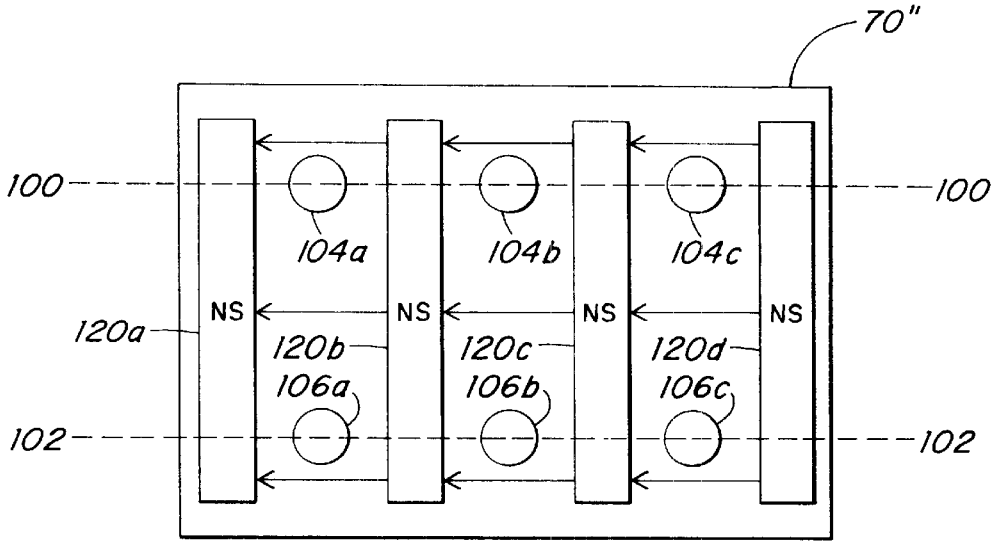
FIG. 5 shows a top view of a plasma electrode that can be utilized in the ion source of FIG. 2.
Figure 6:
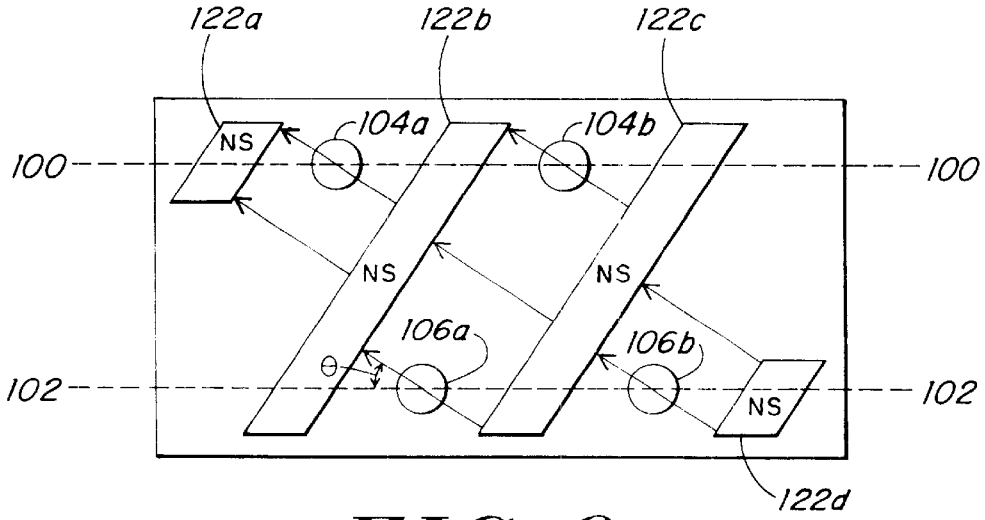
FIG. 6 shows a top-view of another alternative plasma electrode configuration that can be utilized in accordance with the invention.

FIGS. 4–6 demonstrate that the magnetic field lines can be generally oriented at any desired angle relative to a linear array of openings in the plasma electrode. As discussed in the commonly owned U.S. Pat. No. 6,016,036, it may be preferable to orient the magnetic field lines at a predetermined angle relative to the linear array of openings in the plasma electrode in order to improve the current density uniformity of the ion beam. Accordingly, in one aspect of the invention, the magnetic fields are generally oriented at an angle Θ relative to axis 100, wherein Θ is greater than 0 degrees and less than 90 degrees, i.e. the magnetic field lines are neither orthogonal nor parallel to the axis 100.

The pickup arm 32 removes a panel P from the loadlock assembly 16 in a horizontal position (i.e. the same relative position as when the panel resides in the cassettes 12 and 14 and when the panel is being handled by the end effector 18). The pickup arm 32 then moves the panel from this horizontal position in the direction of arrow 44 to a vertical position P2 as shown by the dashed lines in FIG. 1. The translation assembly then moves the vertically positioned panel in a scanning direction, from left to right in FIG. 1, across the part of an ion beam generated by the ion source and emerging from the opening 28.

The ion source 26 outputs a ribbon beam. The term "ribbon beam" as used herein shall mean an elongated ion beam having a length that extends along an elongation axis and having a width that is substantially less than the length and that extends along an axis which is orthogonal to the elongation axis. The term "orthogonal" as used herein shall mean substantially perpendicular. Ribbon beams have proven to be effective in implanting large surface area workpieces because they require only a single unidirectional pass of the workpiece through the ion beam to implant the entire surface area, as long as the ribbon beam has a length that exceeds at least one dimension of the workpiece.

In the system of FIG. 1, the ribbon beam has a length that exceeds at least the smaller dimension of a flat panel being processed. The use of such a ribbon beam in conjunction with the ion implantation system of FIG. 1 provides for several advantages in addition to providing the capability of a single scan complete implant. For example, the ribbon beam ion source provides the ability to process panel sizes of different dimensions using the same source within the same system, and permits a uniform implant dosage by controlling the scan velocity of the panel in response to the sampled ion beam current.

Figure 2:
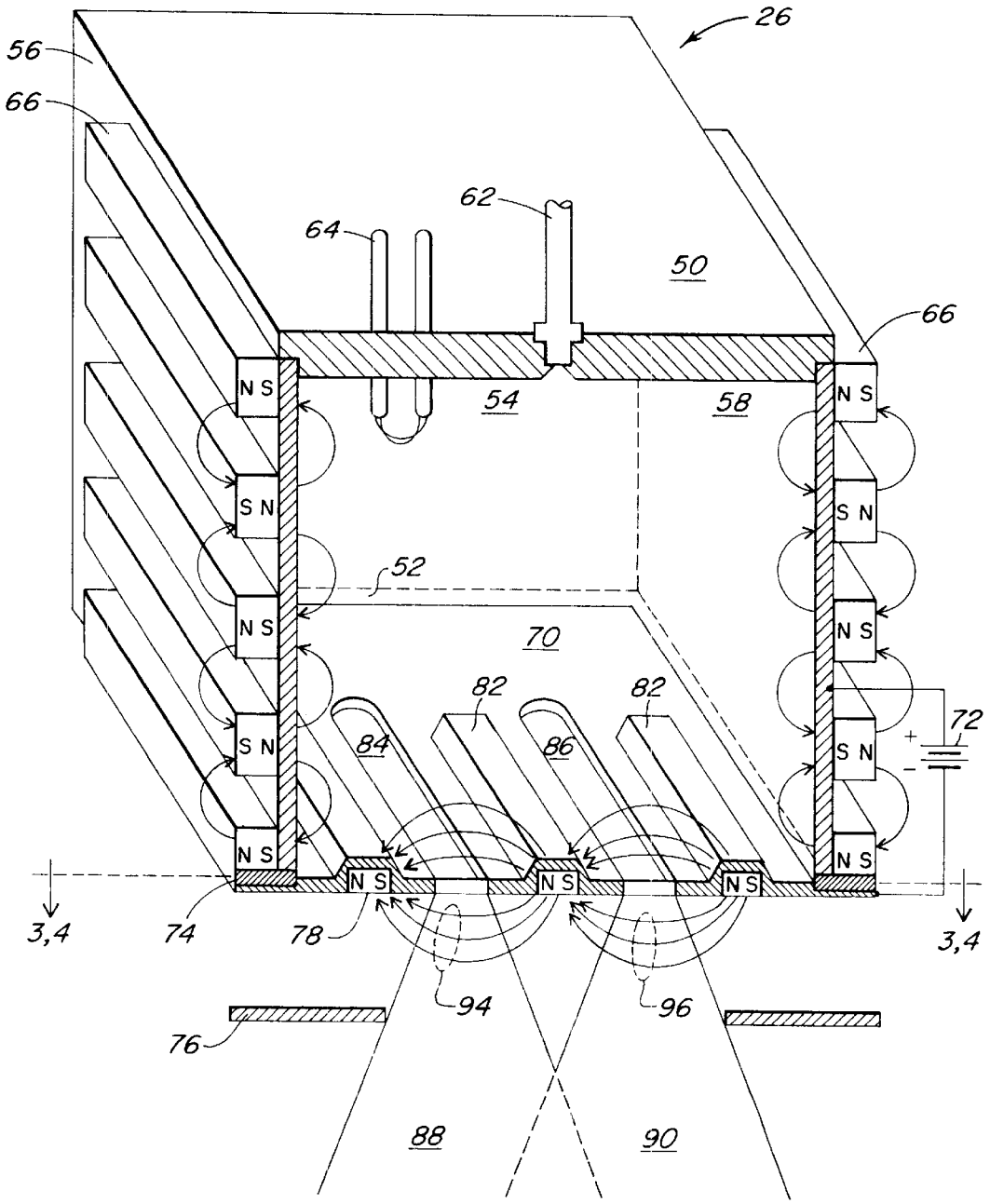
FIG. 2 is a partially cut away, perspective view of an ion source according to the present invention.

FIG. 2 illustrates a perspective view of the ion source 26 shown in FIG. 1. The ion source 26 includes a set of walls defining a plasma confinement chamber 49 for holding a plasma. The plasma confinement chamber 49 can take the form of a parallelepiped, as shown in FIG. 2. Alternatively, the confinement chamber 49 can be shaped like a bucket. The parallelepiped confinement chamber 49 illustrated in FIG. 2 includes a rear wall 50, a front wall 52, and sidewalls 54, 56, 58 and 60 (not shown). The walls of the confinement chamber 49 may be comprised of aluminum or other suitable materials such as stainless steel While graphite, or other suitable materials, can be used to line the interior of these walls.

The rear wall 50 includes a gas inlet 62 and an excitor 64. The inlet is used to release a gas from a gas source (not shown) into the confinement chamber 49. The excitor 64 ionizes the discharged gas to initiate the creation of a plasma within the ion source 26. The excitor 64 can be formed of a tungsten filament which when heated to a suitable temperature thermionically emits electrons. The emitted electrons generated by the excitor interact with and ionize the released gas to form a plasma within the plasma chamber. The excitor can also be formed of other high energy sources, such as an RF antenna that ionizes the electrons by emitting a radio frequency signal.

The ion source 26 further includes a set of bar magnets 66 that urge the plasma towards the center of the plasma confinement chamber 49. The magnets 66 can be formed of a samarium cobalt structure and the magnets are typically fixed into grooves on the outside of the side walls 54, 56, 58 and 60. The magnets are preferably arranged into assemblies in which the poles of the magnets alternate and provide a multi-cusped magnetic field within the housing. As further illustrated in FIG. 2, the bar magnets 66 are polarized so that the north and south poles of each magnet run the length of the magnet. Accordingly, the resulting field lines running from north to south poles of adjacent magnets 66, create a multi-cusped type field that urges the plasma towards the center of the chamber.

The ion source 26 also includes a plasma electrode 70 that forms a generally planer wall section of the front wall 52 of the plasma confinement chamber 49. An insulator 74 can be positioned between the front wall 52 and the sidewalls 54, 56, 58 and 60 in order to electrically isolate the front wall and the plasma electrode structure from the remaining sections of the plasma confinement chamber (e.g. the sidewalls 54, 56, 58 and 60).

The plasma electrode 70 includes a least one opening 84 for allowing an ion beam 88 to exit the housing. The plasma electrode further includes a primary magnet 78 coupled to the plasma electrode and oriented to present one pole along an edge of the opening 84 in the plasma electrode 70. A opposing magnet 80 is also coupled to the plasma electrode 70 and oriented to present an opposite pole along an opposing edge of the opening 84 in the plasma electrode 70. The primary magnet 78 and the opposing magnet 80 form a magnetic field 94 that extends across the opening 84 in the plasma electrode 70 through which the ion beam passes. The magnetic field 94 typically has a field strength exceeding 100 gauss.

An extraction electrode 76 located outside the plasma confinement chamber extracts the plasma through the opening 84, as is known in the art. The extracted plasma forms an ion beam 88 which is conditioned and directed towards the target surface.

In operation, a source gas can be introduced through the gas inlet 62. One exemplary source gas is phosphine ($PH_3$) which is diluted with hydrogen. The resulting phosphine ($PH_3$) plasma comprises $PH_n^+$ ions and $P^+$ ions. In addition to the $PH_n^+$ ions and the $P^+$ ions, the ionization process occurring within the plasma chamber results in the generation of hydrogen ions and high energy electrons. The high energy electrons and hydrogen ions can be undesirable for implantation into target workpieces as they may cause unwanted heating and subsequent damage to the panel.

The magnetic field 94 generated by the primary magnet 78 and the opposing magnet 80 form a magnetic filter at the plasma electrode which aids in reducing the high energy electrons present in the ion beam 88, and accordingly reduces the high energy electrons impacting the workpiece. In particular, the primary and opposing magnets 78, 80 form a relatively strong magnetic field extending over the opening 84, this magnetic field deflects the high-energy electrons with relatively high velocities away from the opening 84. However, lower velocity particles such as ions and low-energy electrons can typically pass through the magnetic field 94. The magnetic field 94 also improves confinement of the plasma within the plasma confinement chamber. By improving the confinement of the plasma, the magnetic field provides for increased beam currents in the ion beam 88.

Preferably, the magnets 78 and 80 are polarized so that the north and south poles of each magnet run the length of the magnet (rather than being polarized end-to-end). The magnets are polarized in the same direction so that opposing poles face each other. As such, the magnetic field line 94 extends between opposing poles of adjacently positioned magnets. The magnetic field line improves plasma confinement and potentially filters high energy electrons from the ion beam 94.

In another aspect of the invention, the plasma electrode 70 includes at least a plurality of openings (i.e. two or more openings). The plasma electrode can include a first opening 84 and a second opening 86 both of which allow ion beams to exit the housing. The first opening 84 forms a first ion beam 94 and the second opening 86 forms a second ion beam 96. The first ion beam 94 and the second ion beam 96 typically overlap at or before the surface of the workpiece undergoing implantation.

As shown in FIG. 2, those plasma electrodes having two or more openings also include three or more magnets to provide a strong confinement field for the plasma. For instance, a primary magnet 78 is oriented to present a south pole along the edge of opening 84 and the opposing magnet 80 is oriented to present a north pole along the opposing edge of opening 84. In addition, the opposing magnet 80 is oriented to present a south pole along the edge of opening 86 and a secondary magnet 82 is oriented to present a north pole along the opposing edge of opening 86. This arrangement produces a first magnetic field 94 that extends across opening 84 and it also produces a second magnetic field 96 that extends across the second opening 86. The magnetic fields 94, 96 form a multi-cusp magnetic field that extends over the openings 84, 86, the multi-cusp magnetic field improves confinement of the plasma and reduces the number of high-energy electrons entering the ion beams 88, 90.

FIG. 2 also illustrates an ion source 26 having a power supply 72 electrically coupled between the plasma electrode 70 and the other sections of the plasma confinement chamber 94. The power supply 72 creates an electrical bias between the plasma electrode 70 and the other sections of the plasma confinement chamber 94. The insulator 74 electrically insulates the plasma electrode from the bulk of the plasma confinement chamber, thus allowing the creation of the electrical bias. Typically, the power supply 72 slightly negatively biases the plasma electrode relative to the sidewalls of the plasma confinement chamber and the bias is generally four volts. This slight negative voltage of the plasma electrode aids in inhibiting negative ions from leaving the plasma chamber through the openings 84, 86.

Figure 3:
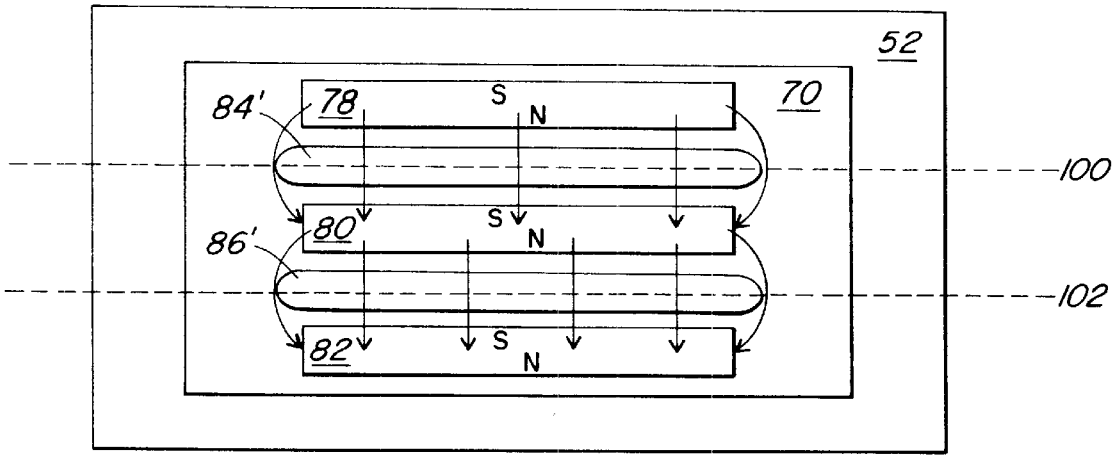
FIG. 3 is a cross-sectional view of a plasma electrode, taken along line 3—3 of FIG. 2.

FIG. 3 illustrates a cross-section of the ion source 26 taken along line 3—3 of FIG. 2. Particularly, FIG. 3 illustrates an exemplary cross-section of the plasma electrode 70. The illustrated plasma electrode 70 includes a plurality of slots shaped openings aligned substantially parallel to each other. For instance, an opening 84' is elongated along the length of axis 100 and an opening 86' is elongated along the length of the axis 102, which lies parallel to axis 100. Opening 84' and opening 86' are slot shaped so that they form ion beams having a cross-sectional ribbon beam shape. Typically, the length of the slot 84' along axis 100 is at least fifty times the width of the slong measured along an orthogonal axis. The illustrated magnets 78, 80 and 82 also have an elongated shape. Each of the magnets presents one pole along an elongated edge of the slotted openings 84', 86'.

The illustrated plasma electrode of FIG. 3 also includes an even number of openings in the plasma electrode. An even number of openings advantageously provides for a more uniform ion beam, as compared to an ion beam produced within odd number of openings.

FIG. 4 illustrates an alternative embodiment of a plasma electrode 70' again as a cross-sectional view (e.g., as if taken along line 4—4 of FIG. 2). The plasma electrode 70' includes a plurality of circular openings 104*a*, 104*b*, 104*c* and 104*d* for passing a stream of ions. The openings 104*a*–104*d* are linearly arranged along axis 100. The plasma electrode can also include a second grouping of circular openings 106*a*, 106*b*, 106*c* and 106*d* for passing a stream of ions. The second group of openings 106*a*–106*d* are linearly arranged along axis 102, which lies substantially parallel to axis 100.

The plurality of openings 104*a*–104*d* are separated by a predetermined distance along axis 100 such that the ion beams formed by each of the respective openings overlap at or before the surface of the workpiece. Thus the openings 104*a*–104*d* approximately form an ion beam having a envelope similar to the ion beam formed by the elongated opening 84'. In an analogous fashion, the openings

106*a*–106*d* are separated by a distance along axis 102 and form ion beams that overlap at or before the workpiece and generate a cumulative ion beam having an envelope that approximates the ion beam formed by opening 86'.

FIG. 4 also shows a plasma electrode 70' having a first set of magnets 108*a,* 108*b,* 108*c* and 108*d* which are oriented to present a north pole along the edge of the openings 104*a*–104*d,* respectively. A second set of magnets 110*a,* 110*b,* 110*c* and 110*d* are oriented to present a south pole along the opposing edge of openings 104*a*–104*d,* respectively. The magnets 110*a*–110*d* are also oriented to present a north pole along the edge of openings 106*a,* 106*b,* 106*c* and 106*d* respectively. Additionally, a third set of magnets, 112*a,* 112*b,* 112*c* and 112*d* are oriented to present a south pole along the edge of the openings 106*a*–106*d,* respectively.

The orientation of the magnets 108*a*–108*d* and 110*a*–110*d* relative to the openings 104*a*–104*d* form a set of magnetic field lines that extend across the openings 104*a*–104*d.* The orientation of the magnets 110*a*–110*d* and 112*a*–112*d* form a second set of magnetic field lines that extend across the set of openings 106*a*–106*d.* These magnetic field lines extend across the openings in a direction generally orthogonal to the linear extension of the array of openings (i.e. orthogonal to axes 100 and 102). In addition, these magnetic field lines improve the confinement of the plasma and reduce the number of high-energy electrons entering the ion beams.

FIG. 5 illustrates a cross-section of an alternative plasma electrode 70". The plasma electrode 70" includes a first set of circular openings 104*a*–104*c* that extend along an axis 100 and a second set of circular openings 106*a*–106*c* that extend along a second axis 102. The plasma electrode also includes a set of magnets 120*a,* 120*b,* 120*c* and 120*d* that generate magnetic field lines extending across the openings 104*a*–104*c* and across the openings 106*a*–106*c.* In comparison to FIG. 4, the magnetic field lines illustrated in FIG. 5 extend across the openings in a direction generally parallel to the linear extension of the array of openings (i.e. parallel to axes 100 and 102).

FIG. 6 illustrates a cross-section of a further alternative plasma electrode 70'". The plasma electrode includes a first set of circular openings 104*a*–104*b* that extend along an axis 100 and a second set of circular openings 106*a*–106*b* that extend along a second axis 102. The plasma electrode also includes a set of magnets 122*a,* 122*b,* 122*c* and 122*d* that generate magnetic field lines extending across the openings 104*a*–104*c* and across the openings 106*a*–106*c.* The magnetic field lines illustrated in FIG. 6 extend across the openings in a direction oriented generally at an angle Θ relative to axis 100 (or axis 102 which lies substantially parallel to axis 100).

FIGS. 4–6 demonstrate that the magnetic field lines can be generally oriented at any desired angle relative to a linear array of openings in the plasma electrode. As discussed in the co-pending, commonly owned U.S. patent application, Ser. No. 09/014,472, now U.S. Pat. No. 6,016,036, it may be preferable to orient the magnetic field lines at a predetermined angle relative to the linear array of openings in the plasma electrode in order to improve the current density uniformity of the ion beam. Accordingly, in one aspect of the invention, the magnetic fields are generally oriented at an angle Θ relative to axis 100, wherein Θ is greater than 0 degrees and less than 90 degrees, i.e. the magnetic field lines are neither orthogonal nor parallel to the axis 100.

Figure 7:
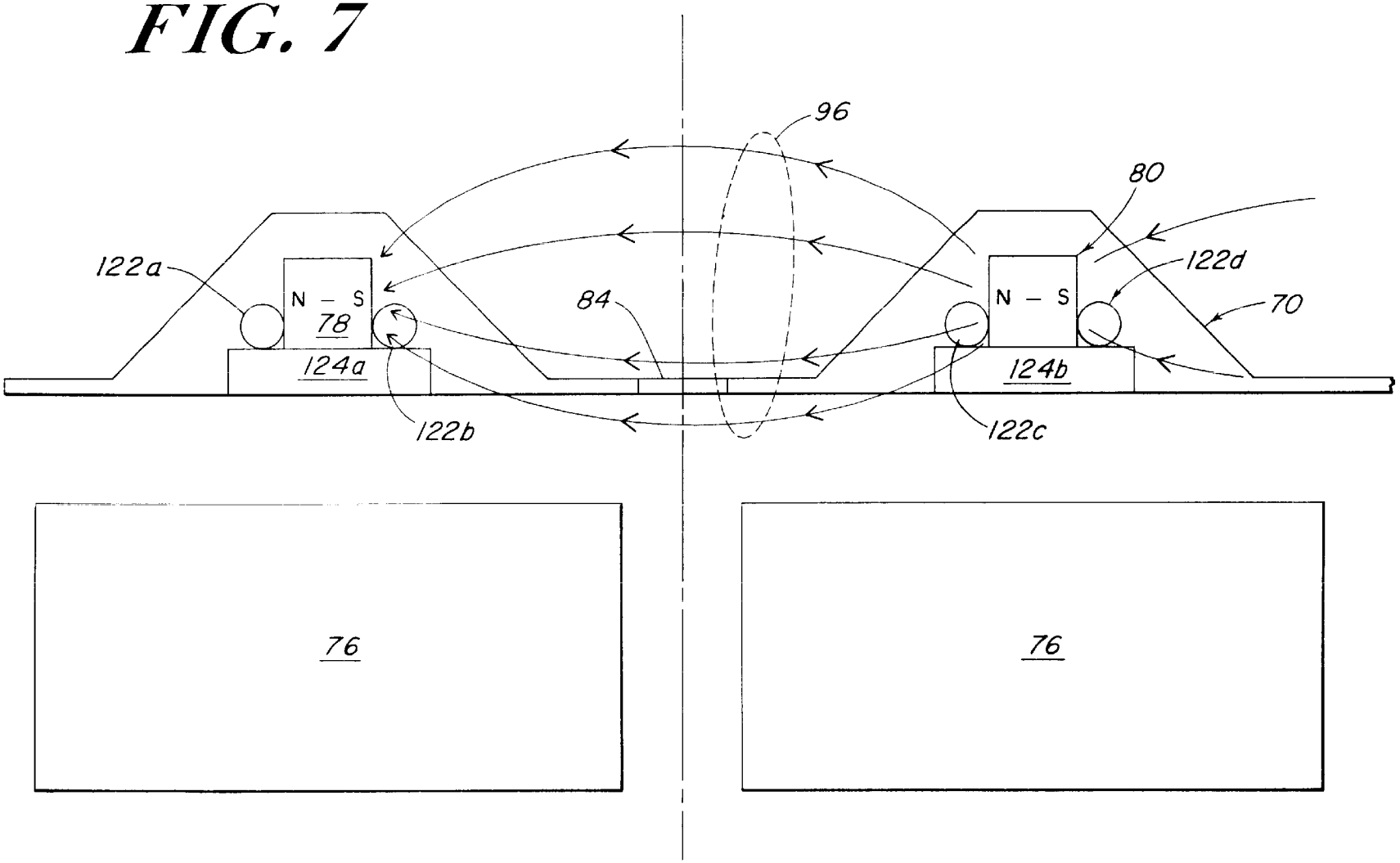
FIG. 7 is an enlarged cross-sectional view showing further details of the plasma electrode of FIG. 2.

FIG. 7 shows further details of the plasma electrode 70 of FIG. 2. The plasma electrode includes the magnets 78 and 80 positioned around opposite sides of the opening 84. The magnets are contained with a section of the plasma electrode 70. The magnet 78 is separated from an internal surface of the plasma electrode by a metallic yolk plate 124*a,* and the magnet 80 is separated from another internal surface of the plasma electrode by a second metallic yolk plate 124*b.* The metallic yolk plates 124*a,* 124*b* can be formed from metals, such as steel.

The illustrated plasma electrode also includes cooling tubes 122*a* and 122*b* mounted adjacent the magnet 78, and cooling tubes 122*c* and 122*d* mounted adjacent the magnet 80. The cooling tubes 122*a* and 122*b* transfer heat away from the magnet 78 and the cooling tubes 122*c* and 122*d* transfer heat away from the magnet 80. The cooling tubes 122*a*–122*d* can be filled with a suitable cooling fluid such as water to transfer heat away from the magnets 78 and 80. The cooling tubes are typically formed of copper.

Figure 8:
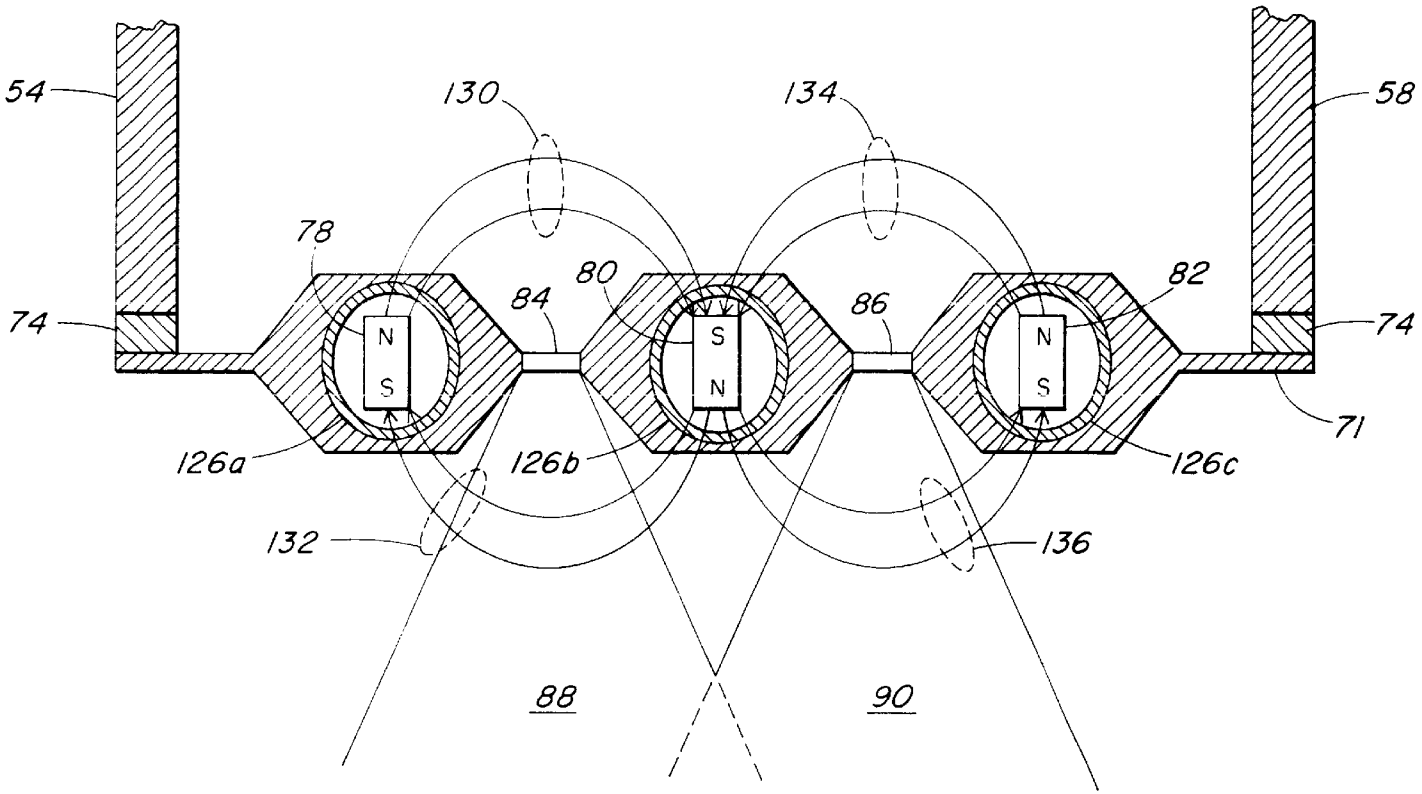
FIG. 8 is another cross-sectional view illustrating other aspects of the plasma electrode of FIG. 2.

FIG. 8 other aspects of the plasma electrode, labeled 71, according to the invention. The plasma electrode 71 includes the first opening 84 and the second opening 86 for forming the first ion beam 88 and the second ion beam 90. The plasma electrode also includes magnets 78, 80 and 82 oriented to form magnetic fields that extend across opening 84 and opening 86. The magnets 78, 80 and 82 are polarized so that the north and south poles of each magnet run the length of the magnet.

The orientation of the magnets 78, 80 and 82, however, differ from the orientation illustrated in FIG. 2. The magnets 78, 80 and 82 are rotated 90 degrees around an axis extending out of the plane of the page, relative to the orientations of the same magnets shown in FIG. 2. The magnets produce magnetic field lines 130, 132, 134 and 136. For example, the magnetic field line 130 extends from the north pole of magnet 78 to the south pole of magnet 80, and the magnetic field line 132 extends from the north pole of magnet 80 towards the south pole of magnet 78. The magnetic field line 134 extends from the north pole of magnet 82 to the south pole of magnet 80, and the magnetic field line 136 extends from the north pole of magnet 80 to the south pole of magnet 82. Magnetic field lines 130–134 aid in confirming the plasma to the plasma chamber and reduce the number of high-energy electrons entering the ion beams 88 and 90.

FIG. 8 also shows the magnets 78, 80 and 82 positioned within the cooling tubes 126*a,* 126*b* and 126*c,* respectively. The cooling tubes 126*a,* 126*b* and 126*c* are hollow and provide passageway for a cooling fluid to flow over the surfaces of the magnets 78, 80 and 82. The cooling tube can be formed of copper, and can be filled with a suitable cooling fluid, such as water, that transfers the heat away from the magnets. The cooling fluid can be pumped through the tubes to further aid in cooling the magnets which are being heated by plasma particles colliding with the plasma electrode 71.

It will thus be seen that the invention efficiently attains the objects set forth above, among those made apparent from the preceding description. Since certain changes may be made in the above constructions without departing from the scope of the invention, it is intended that all matter contained in the above description or shown in the accompanying drawings be interpreted as illustrative and not in a limiting sense.

Having described the invention, what is claimed as new and desired to be secured by Letters Patent is:

1. An ion source including a plasma confinement chamber in which a plasma is generated and including a plasma electrode forming a wall section of the confinement chamber, the plasma electrode having at least one opening for allowing an ion beam to exit the confinement chamber, the improvement comprising:

a power source electrically coupled between any other sections of the plasma confinement chamber and the plasma electrode, the power supply negatively biasing the plasma electrode relative to the other sections of the plasma confinement chamber for inhibiting negative ions from leaving from said plasma chamber through said openings;

a primary magnet coupled to the plasma electrode and having north and south poles that extend along a length of the magnet, said primary magnet being oriented to present one of said poles along an edge of the opening in the plasma electrode;

an opposing magnet coupled to the plasma electrode and having north and south poles that extend along a length of the magnet, said opposing magnet being oriented to present a pole opposite the pole of the primary magnet along an opposing edge of the opening in the plasma electrode such that a magnetic field extends across the opening in the plasma electrode through which the ion beam passes.

2. An ion source including a plasma confinement chamber in which a plasma is generated and including a plasma electrode forming a wall section of the confinement chamber, the plasma electrode having at least one opening for allowing an ion beam to exit the confinement chamber, the improvement comprising:

an insulator electrically insulating the plasma electrode from any other sections of the plasma confinement chamber, a power source electrically coupled between the other sections of the plasma confinement chamber and the plasma electrode, the power supply negatively biasing the plasma electrode relative to the other sections of the plasma confinement chamber a primary magnet coupled to the plasma electrode and having north and south poles that extend along a length of the magnet, said primary magnet being oriented to present one of said poles along an edge of the opening in the plasma electrode, and an opposing magnet coupled to the plasma electrode and having north and south poles that extend along a length of the magnet, said opposing magnet being oriented to present a pole opposite the pole of the primary magnet along an opposing edge of the opening in the plasma electrode such that a magnetic field extends across the opening in the plasma electrode through which the ion beam passes, wherein said primary magnet and the opposing magnet generate a magnetic field that extends over the openings in the plasma electrode through which the ion beam passes for filtering selected ions from the ion beam.

3. An ion source according to claim 2, wherein the magnetic field extending across the opening is greater than 100 gauss.

4. An ion source according to claim 2, wherein the opening in the plasma electrode is a slot.

5. An ion source according to claim 4, wherein the length of the slot is at least 50 times the width of the slot.

6. An ion source according to claim 4, wherein the plasma electrode includes a plurality of slots aligned substantially parallel to each other.

7. An ion source according to claim 6 including an even number of slots in the plasma electrode, each slot being aligned substantially parallel to the other slots.

8. An ion source according to claim 4, wherein the primary magnet and the opposing magnet are elongated and wherein the primary magnet and the opposing magnet extend along the length of the slot in the plasma electrode.

9. An ion source according to claim 2, wherein the plasma electrode includes a plurality of circular openings aligned along an axis.

10. An ion source according to claim 9, wherein the primary magnet and the opposing magnet are positioned relative to the opening such that the magnetic field is generally oriented at an angle $\Theta$ relative to the axis, the angle $\Theta$ being greater than 0 degrees and less than 90 degrees.

11. An ion source according to claim 2, further comprising a second opening in the plasma electrode, the second opening positioned such that the opposing magnet lies between the opening and the second opening, and a secondary magnet coupled to the plasma electrode and oriented to present a pole along the edge of the second opening such that the opposing magnet and the secondary magnet form a secondary magnetic field that extends across the second opening in the plasma electrode.

12. An ion source according to claim 2, further comprising a cooling tube mounted adjacent the primary magnet for transferring heat away from the primary magnet.

13. An ion source according to claim 2, wherein the primary magnet is positioned within a hollow cooling tube filled with a cooling fluid and wherein the cooling tube is mounted to the plasma electrode.

14. An ion source according to claim 2, further comprising a magnetic yoke positioned between the primary magnet and an interior surface of the plasma electrode.

15. A plasma electrode for use in an ion source, the ion source including a plasma confinement chamber in which a plasma is generated and wherein the plasma electrode is adapted to form a wall section of the confinement chamber, the plasma electrode including at least one opening for allowing an ion beam to exit the confinement chamber, the electrode comprising:

an insulator electrically insulating the plasma electrode from any other sections of the plasma confinement chamber, a power source electrically coupled between the other sections of the plasma confinement chamber and the plasma electrode, the power supply negatively biasing the plasma electrode relative to the other sections of the plasma confinement chamber a primary magnet coupled to the plasma electrode and oriented to present one pole along an edge of the opening in the plasma electrode, and an opposing magnet coupled to the plasma electrode and oriented to present an opposite pole along an opposing edge of the opening in the plasma electrode such that a magnetic field extends across the opening in the plasma electrode through which the ion beam passes, wherein said primary magnet and the opposing magnet generate a magnetic field that extends over the openings in the plasma electrode through which the ion beam passes for filtering selected ions from the ion beam.

16. A plasma electrode according to claim 15, wherein the opening in the plasma electrode is a slot.

17. A plasma electrode according to claim 16, wherein the length of the slot is at least 50 times the width of the slot.

18. A plasma electrode according to claim 16, wherein the plasma electrode includes a plurality of slots aligned substantially parallel to each other.

19. A plasma electrode according to claim 18, further comprising an even number of slots in the plasma electrode, each slot being aligned substantially parallel to the other slots.

20. A plasma electrode according to claim 16, wherein the primary magnet and the opposing magnet are elongated and wherein the primary magnet and the opposing magnet extend along the length of the slot in the plasma electrode.

21. A plasma electrode according to claim 15, wherein the plasma electrode includes a plurality of linearly arranged circular openings.

22. A plasma electrode according to claim 15, further comprising a second opening in the plasma electrode, the second opening positioned such that the opposing magnet lies between the opening and the second opening, and a secondary magnet coupled to the plasma electrode and oriented to present a pole along the edge of the second opening such that the opposing magnet and the secondary magnet form a secondary magnetic field that extends across the second opening in the plasma electrode.

* * * * *